US006708941B1

(12) United States Patent
Bowen et al.

(10) Patent No.: US 6,708,941 B1
(45) Date of Patent: Mar. 23, 2004

(54) ATTACHMENT OF FURNITURE SAFETY CUSHION VIA ELASTOMERIC CARRIER LOOP

(75) Inventors: Cynthia L. Bowen, Washington, NC (US); Walter L. Bowen, Washington, NC (US)

(73) Assignee: KidKusion, Inc., Washington, NC (US)

( * ) Notice: Subject to any disclaimer, the term of this patent is extended or adjusted under 35 U.S.C. 154(b) by 0 days.

(21) Appl. No.: 10/459,627

(22) Filed: Jun. 11, 2003

(51) Int. Cl.[7] ..... A47B 95/00
(52) U.S. Cl. ..... 248/345.1; 108/27
(58) Field of Search ..... 248/345.1, 615; 108/27; 52/716.3, 716.4

(56) References Cited

U.S. PATENT DOCUMENTS 3,960,354 A * 6/1976 Simikoski ..... 248/345.1
4,153,230 A * 5/1979 Giacin ..... 248/345.1
5,908,681 A * 6/1999 Foster ..... 428/99
6,019,336 A * 2/2000 Havens ..... 248/345.1

* cited by examiner

*Primary Examiner*—Korie Chan
(74) *Attorney, Agent, or Firm*—Coats & Bennett, P.L.L.C.

(57) ABSTRACT

A method for protecting a child from injury includes forming a carrier loop from an elongate strip of elastomeric material; applying the carrier loop to a perimeter edge of a furniture piece so as cover an adjacent portion of an upper surface and an adjacent portion of a side surface of the furniture piece; attaching a cushion bumper to an external surface of the carrier loop so that the carrier loop is disposed between the cushion bumper and the furniture piece, the cushion bumper having a thickness greater than the thickness of the strip. The longitudinal tension in the carrier loop may assist in attaching the carrier loop to the furniture piece. The strip may be a vinyl strip with a hardness of 30–60 Shore A and may be assembled from a plurality of connected segments. The furniture, carrier loop, and cushion bumper may form an assembly.

19 Claims, 4 Drawing Sheets

ATTACHMENT OF FURNITURE SAFETY CUSHION VIA ELASTOMERIC CARRIER LOOP

FIELD OF THE INVENTION

The present invention is directed generally the field of child safety cushions, and more particularly to a method and apparatus for attaching safety cushions to furniture without marring the furniture.

BACKGROUND OF THE INVENTION

It is well known that as children learn to walk, they have a tendency to fall down, sometimes against furniture. Also, it is well known that children playing in a house are not always careful and may trip, fall, or be pushed into furniture. Accordingly, there are a number of safety cushion products on the market for protecting children from furniture, and vice versa. One very successful example is a cushion known as a TODDLER EDGE KUSION brand table edge guard, model number 5004, made by Kidkusion, Inc. of Washington, N.C. This table edge guard is a long strip of cushion material with an L-shaped cross-section. The cushion material is placed around the upper perimeter edge of a table, such as a coffee table, so as to cover the table's underlying sharp perimeter edge. The cushion material is secured to the table by suitably placed double-sided tape.

While the above product works quite well for its intended purpose, the use of double-sided tape for securing the cushion material is sometimes undesirable, due to the tendency of the double-sided tape to mar or otherwise harm the surface of the furniture. For example, when the children have grown sufficiently, or the furniture is to be sold, the cushion material is removed. In removing the cushion material, the double-sided tape sometimes remains partially attached to the furniture, leaving a residual gummy deposit, and may discolor the surface of the furniture. The process of fully removing the double-sided tape may further damage the furniture.

As such, there remains a need for alternative designs of child safety devices for furniture that provide better protection against damage to the furniture when the safety device is removed.

SUMMARY OF THE INVENTION

The method of the present invention is directed to a method of protecting a child from injury typically comprising joining a first end of an elongate strip of elastomeric material to a second end thereof form a carrier loop; applying the carrier loop to a perimeter edge of a furniture piece so as cover an adjacent portion of an upper surface and an adjacent portion of a side surface of the furniture piece, the carrier loop covering at least substantially all of the perimeter edge; attaching a cushion bumper to an external surface of the carrier loop so that the carrier loop is disposed between the cushion bumper and the furniture piece, the cushion bumper having a thickness greater than the thickness of the strip. Preferably, the longitudinal tension in the carrier loop assists in the attaching the carrier loop to the furniture piece. The method may further include cutting a plurality of slits in the carrier loop such that the slits are proximate the corners. The strip may be a vinyl strip, preferably with a hardness of 30–60 Shore A, and may be assembled from a plurality of segments prior to the joining. The cushion bumper may have a generally L-shaped cross-section prior to the attaching and the strip may have a substantially corresponding cross-section to the interior surface of the cushion bumper prior to the applying. Further, the cushion bumper may hide substantially all of the carrier loop when attached to carrier loop.

An assembly used in the method above includes a furniture piece having a top, a side, and an perimeter edge therebetween; an elongate carrier loop of elastomeric material disposed proximate the perimeter edge so as to cover substantially all of the perimeter edge, the carrier loop having a thickness; and a cushion bumper attached to an external side of the carrier loop such that the carrier loop is disposed between the furniture piece and the cushion bumper, the cushion bumper having a thickness greater than the carrier loop thickness.

DETAILED DESCRIPTION OF THE INVENTION

The following description of a preferred embodiment of the present invention will be in the context of a conventional wooden coffee table as an illustrative example of a relevant piece of furniture 10. However, it should be noted that the present invention may be used with a wide variety of furniture, and is not limited to use with conventional wooden coffee tables.

Figure 1:
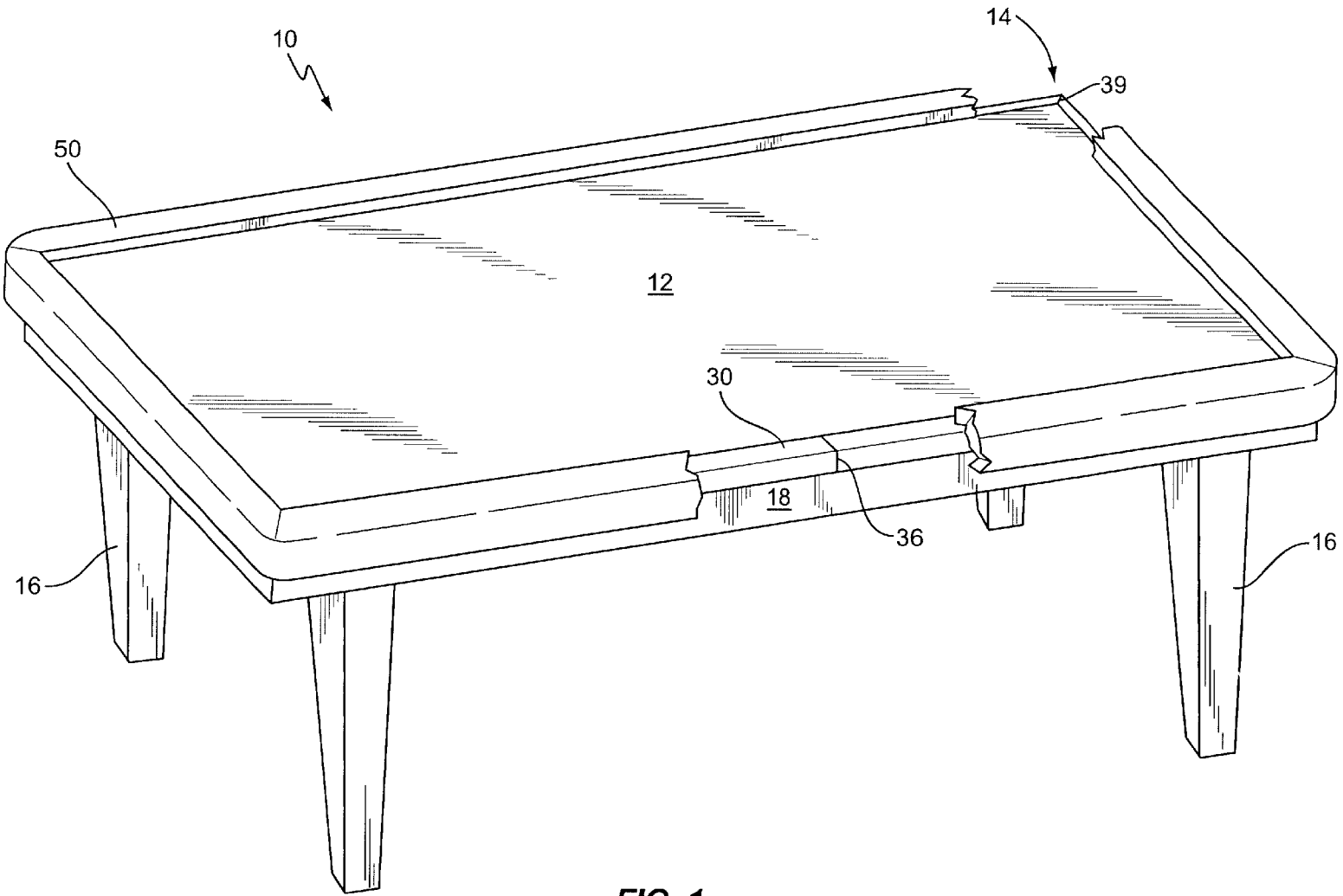
FIG. 1 is a perspective view of a safety cushion attached to a table in accordance with the present invention.

As illustrated in FIG. 1, a table 10 typically has a generally flat upper surface or top 12, bounded by corners 14 and supported by a plurality of downwardly extending legs 16. A perimeter edge 20 is formed where the top 12 meets the table's side surfaces 18. This perimeter edge 20 is typically a relatively sharp lip in profile (see FIG. 2) due to aesthetic and other considerations. In order to protect children from injury, a cushioned bumper 50 may be removably mounted to the table 10 so as to substantially, if not entirely, cover the sharp perimeter edge 20. According to the present invention, the cushion bumper 50 does not primarily attach directly to the table 10, but instead primarily attaches to the table 10 via an elastomeric carrier loop 30.

Figure 3A:
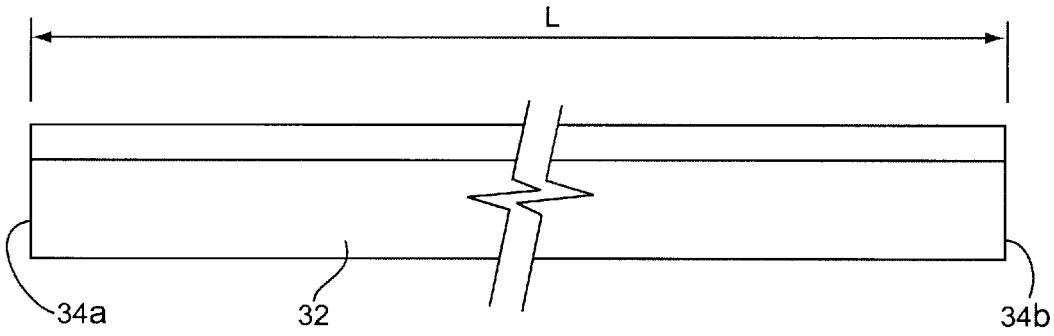
FIG. 3 is a perspective view of a carrier loop of suitable for the present invention.
Figure 3B:
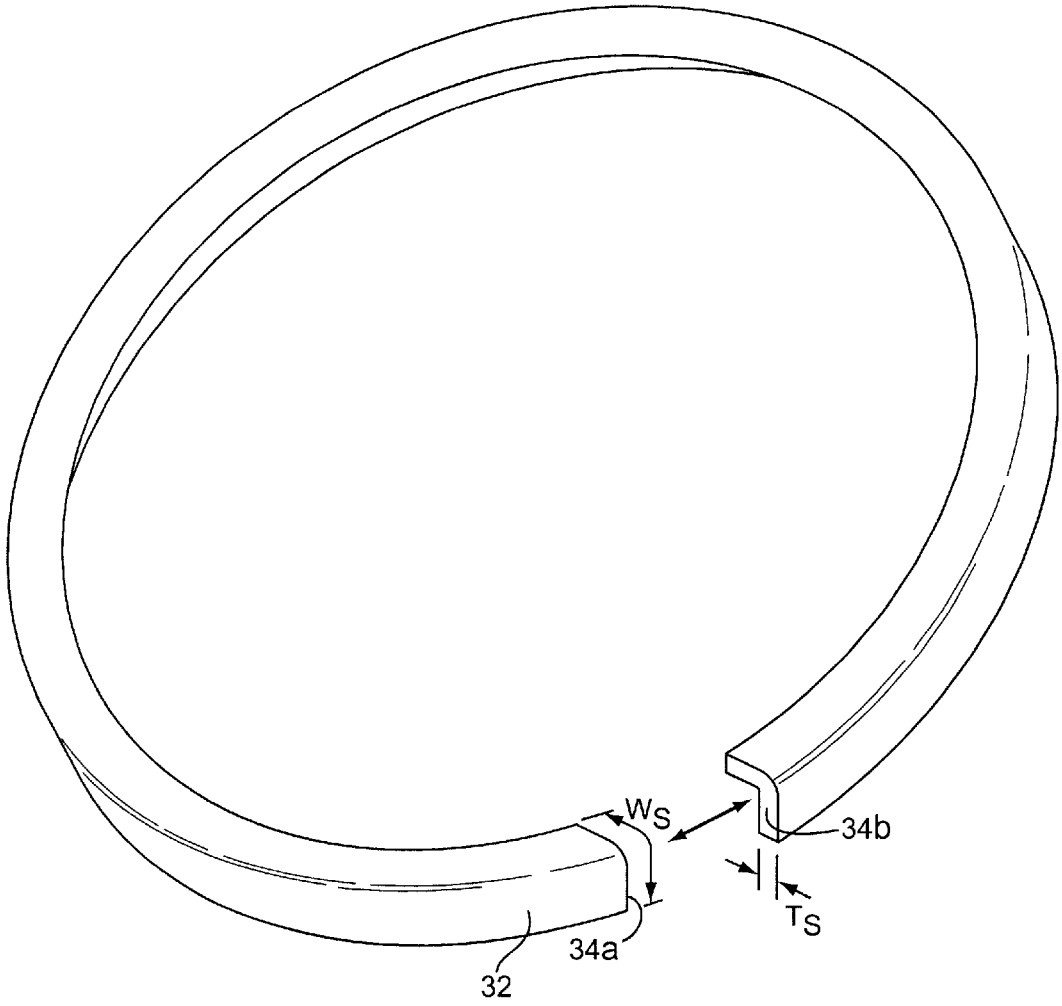

The carrier loop 30 is formed from a strip 32 of elastomeric material, such as that shown in FIG. 3. The strip 32 has a length $L_s$, a thickness $T_s$, a width $W_s$, and respective ends 34*a*,34*b*. As can be seen, the strip 32 is substantially wider than it is thick. The material of the strip 32 should be at least somewhat elastic in order to provide mounting tension, as described more fully below. In addition, the material of the strip 32 is preferably somewhat tacky, but is free of any adhesive coatings. Suitable materials include without limitation vinyl, thermoplastic rubber (TPR), and the like, particularly those with a hardness of 30–60 Shore A, and more preferably approximately 40 Shore A. Preferably, the material of strip 32 is clear, or at least translucent, so that the underlying perimeter edge 20 of the table 10 can be seen during installation. Further, while not required for all embodiments, the strip 32 may advantageously have an angled cross-section, such as an L-shaped cross section before assembly.

Figure 4A:
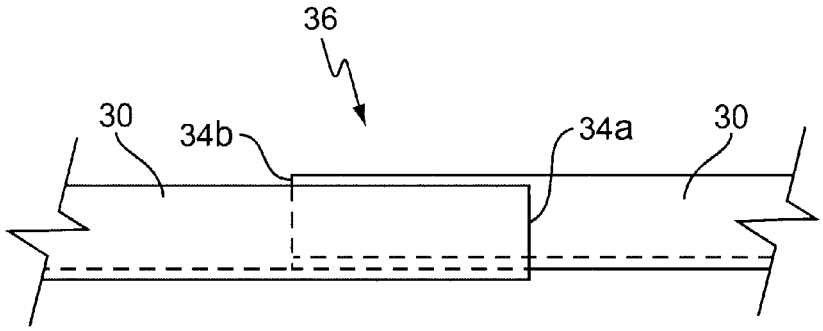
FIGS. 4A–C show an overlapping splice, a butt splice with extra material, and an angled splice with simple tape, respectively, for joining ends of the strip forming the carrier loop of FIG. 3.
Figure 4B:
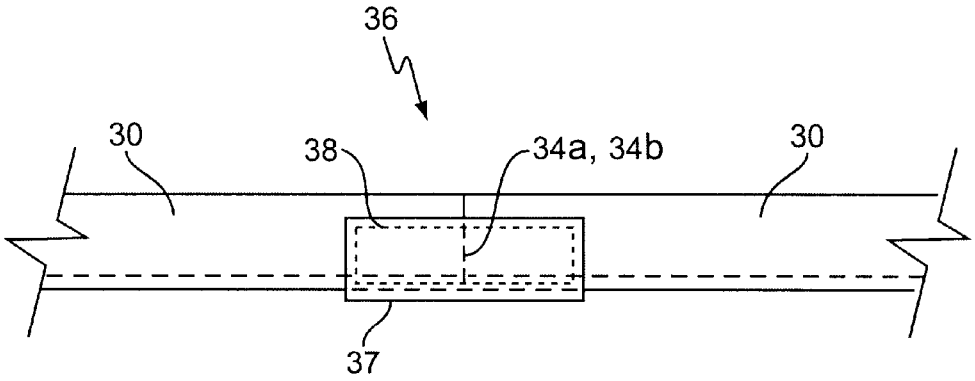
Figure 4C:
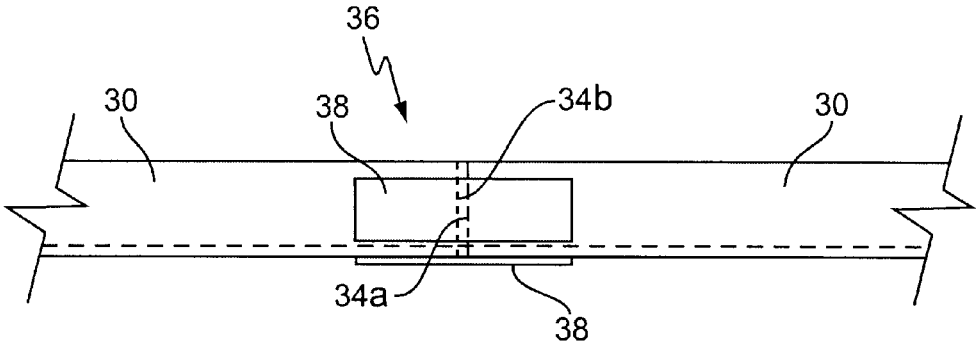

The carrier loop 30 is formed by the end user joining the respective ends 34*a*,34*b* of the strip 32 to form a loop 30. The ends 34*a*,34*b* may be advantageously joined together directly, by splicing the ends together, such as in the form of an overlapping splice 36, a butt splice 36, or an angled splice 36 (see FIGS. 4A–C). For instance, an overlapping splice may be used as shown in FIG. 4A, with suitable double-sided tape or adhesive (neither shown) disposed between the overlapping portions of the strip 32. Alternatively, a butt splice as shown in FIG. 4B may be used, with additional material 37 added over the location where the ends 34*a*,34*b* meet and double-sided tape 38 or adhesive underneath the extra material 37. Note that this extra material 37 may be portion of the strip 32 that has been cut off to properly size the resulting carrier loop 30. Further still, an angled splice may alternatively be used as shown in FIG. 4C, with common single-sided adhesive tape 38 suitably disposed with the non-sticky side pointed away from the strip 32. The angle of the angle splice may be across the thickness of the strip $T_s$, and/or may be across the width of the strip $W_s$. For all splices 36, heat or other means may also be employed to fuse the end sections together if desired.

The discussion above has assumed that the strip 32 is a single continuous piece of material; and, indeed, this is a preferred arrangement. However, the strip 32 may be formed of a plurality of segments 32*a* that are joined together by the end user, if desired. Such segments 32*a* are represented by dashed lines in FIG. 3. The multi-segment strip 32 may be advantageous for minimizing shipping requirements, but is disadvantageous due to the added complexity.

Once formed, the carrier loop 30 may be applied to the table 10. The carrier loop 30 is placed around the perimeter edge 20 of the table 10. Preferably, the carrier loop 30 is slightly undersized so that the carrier loop 30 must be slightly stretched longitudinally to fit the perimeter edge 20. If so, then releasing the carrier loop 30 will cause the inherent tension in the carrier loop 30 to pull the loop 30 inward and assist in securing the carrier loop 30 to the table 10. When fully applied to the table 10, the carrier loop 30 preferably extends laterally over an adjacent portion of the top 12, around the lip, and down an adjacent portion of the table's side 18. See FIG. 2.

It should be noted that the carrier loop 30 may be formed by the end user with the strip 32 already disposed partly or fully around the table 10. For instance, the strip 32 may be roughly positioned around the perimeter edge 20, and then the two ends 34*a*,34*b* joined to form the loop 30. Thus, no particular sequence is required between the carrier loop 30 formation and the carrier loop 30 application to the table 10. Further, in order to avoid bunching at the corners 14, suitable slits 39 may be cut in the carrier loop 30, proximate the corners 14, to allow the upward facing portion of the carrier loop 30 to lie flat against the table's top 12.

With the carrier loop 30 disposed about the perimeter edge 20, the cushion bumper 50 may be added. The cushion bumper 50 is attached to the carrier loop 30 by placing it around the now-covered perimeter edge 20 and securing it to the carrier loop 30 with suitable adhesives or double-sided tape 52. It should be noted that the cushion bumper 50 may be a single continuous piece, or may be formed from discrete segments cut to length. The cushion bumper 50 preferably has an angled cross-section (e.g., L-shaped) with an interior surface 54 that corresponds to the shape of the perimeter edge 20 and adjacent portions of the table top 12 and table side 18. The cushion bumper 50 is formed from a cushioning material known in the safety field, and has a thickness $T_c$ proximate the perimeter edge 20 that is significantly thicker than the strip's thickness $T_s$, such as five to ten times as thick. Just by way of non-limiting example, the cushion bumper 50 may be Model 5004 TODDLER EDGE KUSION brand available from Kidkusion, Inc. of Washington, N.C.

Figure 2:
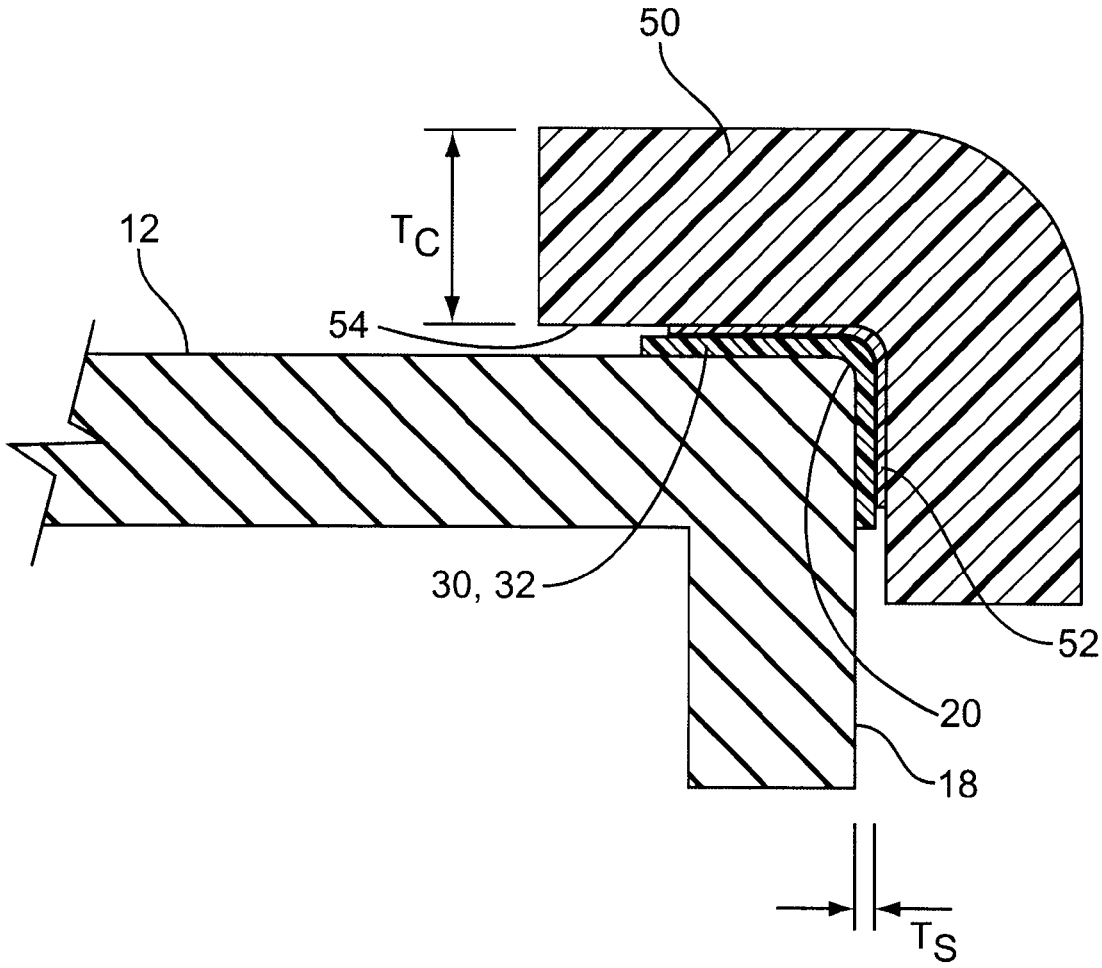
FIG. 2 is a sectional view showing the relationship between the table, the carrier loop, and the safety cushion of FIG. 1.

It is intended that the carrier loop 30 is disposed between the cushion bumper 50 and the table 10. As such, it is advantageous for the outer shape of the strip 32 forming the carrier loop 30 to pre-formed to correspond to that of the interior surface of the bumper 50. Further, while the carrier loop 30 may be as wide as the bumper 50, so as to be flush mounted to the table 10, it may be advantageous in some situations to have the carrier loop 30 be of a width narrower than the bumper 50. As such, the bumper 50 may extend laterally around the carrier loop 30, and possibly touch the table 10, but it is believed to be advantageous if the bumper 50 is spaced away from the table 10 across its entire lateral width, as shown in FIG. 2.

The cushion bumper 50 advantageously extends fully around the perimeter edge 20 of the table 10; however, the approach of the present invention may also be used with the carrier loop 30 extending around the perimeter edge 20, but with the cushion bumper 50 material limited to corner 14 locations.

It should be noted that while the illustrative discussion above has been in terms of a traditional four-sided wooden coffee table 10, the table 10 may be configured differently (e.g., hexagon, round, etc.). Further, it should be noted that the carrier loop 30 and the cushion bumper 50 may optionally have a U-shaped cross sections before assembly so as to extend laterally over an adjacent portion of the top 12, around the lip, down the table's entire side 18, and around onto an adjacent portion of the underside of the table 10, if desired.

The use of the carrier loop 30 to mount to the table 10 allows mounting of the cushion bumper 50 without risk of marring or otherwise damaging the table's surfaces 12,18. The carrier loop 30 is held in place by its internal tension, and possibly through contact friction, but is not chemically adhered to the table's surfaces 10,18. As such, the cushion bumper 50 may be removed by simply pulling the carrier loop 30 off the perimeter edge 20, leaving an undamaged table 10.

The present invention may, of course, be carried out in other specific ways than those herein set forth without departing from the essential characteristics of the invention. The present embodiments are, therefore, to be considered in all respects as illustrative and not restrictive, and all changes coming within the meaning and equivalency range of the appended claims are intended to be embraced therein.

What is claimed is:

1. A method of protecting a child from injury, comprising:

joining a first end of an elongate strip of elastomeric material to a second end thereof form a carrier loop, said strip having a thickness;

applying said carrier loop to a perimeter edge of a furniture piece so as cover an adjacent portion of an upper surface and at least an adjacent portion of a side surface of said furniture piece, said carrier loop covering at least substantially all of said perimeter edge;

attaching a cushion bumper to an external surface of said carrier loop so that said carrier loop is disposed between said cushion bumper and said furniture piece, said cushion bumper having a thickness greater than said strip thickness.

2. The method of claim 1 wherein said joining said first and second end comprises splicing said first end to said second end using a splice selected from the group consisting of a butt splice, an angle splice, and an overlapping splice.

3. The method of claim 1 further comprising assembling said strip from a plurality of segments prior to said joining.

4. The method of claim 1 wherein said attaching said cushion bumper to said carrier loop hides substantially all of said carrier loop between said cushion bumper and said furniture piece.

5. The method of claim 1 wherein said strip is a vinyl strip.

6. The method of claim 1 wherein said strip has a material hardness in the range of 30–60 Shore A.

7. The method of claim 1 wherein said cushion bumper has a generally L-shaped cross-section with an interior surface prior to said attaching, and wherein said strip has a cross-section substantially corresponding to said interior surface prior to said applying.

8. The method of claim 1 wherein longitudinal tension in said carrier loop assists in said attaching said carrier loop to said furniture piece.

9. The method of claim 1 wherein said perimeter edge includes a plurality of corners, and further comprising cutting a plurality of slits in said carrier loop such that said slits are proximate said corners.

10. The method of claim 1 wherein said attaching comprises attaching said cushion bumper to said furniture piece so that said cushion bumper substantially surrounds said perimeter edge.

11. An assembly, comprising:

a furniture piece having a top, a side, and an perimeter edge therebetween;

an elongate carrier loop of elastomeric material disposed proximate said perimeter edge so as to cover substantially all of said perimeter edge, said carrier loop having a thickness;

a cushion bumper attached to an external side of said carrier loop such that said carrier loop is disposed between said furniture piece and said cushion bumper, said cushion bumper having a thickness greater than said carrier loop thickness.

12. The assembly of claim 11 wherein said carrier loop includes a plurality of segments.

13. The assembly of claim 11 wherein said carrier loop comprises first and second ends joined together.

14. The assembly of claim 13 wherein said second end is secured to said first end by tape, said tape un-adhered to said furniture.

15. The assembly of claim 11 wherein said loop is a vinyl loop.

16. The assembly of claim 14 wherein said loop has a material hardness in the range 30–60 Shore A.

17. The assembly of claim 11 wherein said perimeter edge of said furniture piece has a rectangular outline.

18. A method of protecting a child from injury, comprising:

applying an elastomeric carrier loop to a perimeter edge of a furniture piece so as cover an adjacent portion of an upper surface and at least an adjacent portion of a side surface of said furniture piece and laterally covering at least substantially all of said perimeter edge, said carrier loop having a thickness attaching a cushion bumper to an external surface of said carrier loop so that said carrier loop is disposed between said cushion bumper and said furniture piece, said cushion bumper having a thickness greater than said carrier loop thickness.

19. The method of claim 18 wherein said attaching said cushion bumper to said carrier loop hides substantially all of said carrier loop between said cushion bumper and said furniture piece.

* * * * *